United States Patent [19]

Emery

[11] 4,276,123

[45] Jun. 30, 1981

[54] COKE OVEN BATTERY BENCH CLEANING APPARATUS

[75] Inventor: William G. Emery, Pittsburgh, Pa.

[73] Assignee: Koppers Company, Inc., Pittsburgh, Pa.

[21] Appl. No.: 189,374

[22] Filed: Sep. 22, 1980

[51] Int. Cl.[3] ..... C10B 43/04; C10B 33/14; C10B 25/12

[52] U.S. Cl. ..... 202/241; 202/248; 202/262; 202/270; 414/212; 414/215

[58] Field of Search ..... 202/241, 248, 262, 270; 414/209, 212, 214, 215; 201/2

[56] References Cited

U.S. PATENT DOCUMENTS

| | | | |
|---|---|---|---|
| 2,224,392 | 12/1940 | Imes | 414/212 X |
| 3,990,949 | 11/1976 | Ovsyannikov | 202/241 |
| 4,026,768 | 5/1977 | Bahnsch et al. | 202/262 X |
| 4,166,007 | 8/1979 | Becker, Jr. | 202/262 |

*Primary Examiner*—Frank W. Lutter

*Assistant Examiner*—Roger F. Phillips

*Attorney, Agent, or Firm*—R. Lawrence Sahr

[57] ABSTRACT

In a coke oven coke side door machine, a bottom tray is mounted to collect spillage that results from the removal of coke oven doors as well as the residue buildup that is scraped from the door seals and bottom plugs during the door cleaning operation. Trays, in the form of inclined planes, are extended from the door machine to catch the coke spillage from the oven and to catch the residue buildup which is scraped from the door jambs during the jamb cleaning operations. This material gravitates down the trays into the catch pan. A scraper then pushes the material accumulated in the catch pan to one end of that catch pan where a conveyor carries it to a dump bucket. The dump bucket can be dumped when the door machine is positioned adjacent a quench car. All of the above apparatus is mounted onto and within the confines of the door machine.

10 Claims, 5 Drawing Figures

COKE OVEN BATTERY BENCH CLEANING APPARATUS

BACKGROUND OF THE INVENTION

1. Field of the Invention

This invention relates to the manufacture of coke in slot-type coke oven batteries and more specifically to the clean-up of coke spilled during the pushing operations.

2. Description of the Prior Art

In the modern manufacture of coke it is conventional to use a battery, or series, of horizontal slot-type coke ovens to carbonize the coal in the production of either metallurgical or foundry grades of coke. The coal is loaded into these ovens from either an overhead larry car system or a pipeline charging system. Each of the ovens is generally in the form of a slot, for example, dimensions of 12 feet in height, 18 inches in width and 45 feet in length might be found. The coal is generally introduced through holes or ports in the top. The ends of the slots are covered with doors, including seals, to prevent the introduction of air and the leakage of gas during the coking cycle. After the coal is loaded in, it is leveled by conventional equipment, which will not be described, and heated at a substantially elevated temperature for a sustained period of time, for example 1,200° F. for 18 hours. Once this coking cycle has been completed, the doors on both ends of the slot are removed. A conventional pusher machine, which also will not be described, is positioned at the pusher side of the oven and a coke guide is positioned at the opposite, or coke side, of the oven slot. The coke guide is basically a slot extension having generally the same height and width as the coke oven. However, it is generally shorter in length, being for example about 8 feet long. The coke guide is made of steel and is mounted upon a movable carriage which travels along a pair of rails. The rails run parallel to the coke side of the battery, transverse to the length of the coke ovens. The rails are mounted on a shelf-like projection which extends from the coke side of the coke oven battery, running parallel to and the full length of the coke side of the coke oven battery. This shelf-like projection is the coke side bench and its upper horizontal surface is positioned somewhat below the floor of the coke ovens, for example, 3 feet.

At the end of the coke cycle, the doors are removed from both the coke side and pusher side of the oven. This is accomplished by door removers which are mounted on movable frames on door machines and pusher machines. The coke side door machine operates on the same rails as the coke guide. On the pusher side of the battery, the door machine is usually incorporated into the pusher.

In modern operations, the door machines not only serve to remove and replace the oven doors, but also include door seal, door plug, and door jamb cleaning apparatus which serves to scrape the tar and residue build-ups from these surfaces.

During the door removal, some hot coke spills from the ends of the ovens onto the benches (there is also usually a pusher side bench similar to the coke side bench but with no rails on it). In addition, the material that is scraped from the door seals, jambs and plugs falls onto the bench. This material all accumulates and builds up on the benches. Because of the track rails on the coke side bench and the need for clearance to move both the door machine and the cokeguide, the accumulation causes a problem.

In order to eliminate the accumulation of coke and scraped residue from the coke side bench, past practice has been to have one or more men shovel and broom the accumulation off.

Recent governmental regulations have dictated against the liberal use of manpower on or near the coke oven batteries except when absolutely necessary and then only with proper protective clothing and breathing apparatus. This clothing and breathing apparatus makes it difficult for its wearer to freely maneuver, diminishing the economy and effectiveness of utilizing manpower to clean the coke side bench. Thus there is a need for alternate procedures and tools to handle this job.

SUMMARY OF THE INVENTION

In a conventional door machine, which includes a door seal cleaner, a door plug cleaner and a door jamb cleaner, the operation is performed by first aligning the door removal mechanism with the particular door to be removed. The door removal mechanism is advanced toward the door, the door latches are released and the door is lifted away from the door jamb as the door removal mechanism is retracted to the cleaning position on the door machine. As the door is lifted away, some coke from within the oven spills out. This spillage falls into a spillage tray which is advanced upwardly in an inclined fashion toward the bottom of the door jamb before the door is lifted away. The spillage tumbles down the incline of the tray and into a catch pan at the base of the frame of the door machine.

Once the door has been lifted away from the jamb and withdrawn with the door removal mechanism to the retracted position, the door is vertically pivoted on the door removal mechanism about 90° to be engaged by the door seal and door plug cleaners. These cleaners scrape the built-up tar and other residue from the seal and plug allowing the scrapings to fall into the catch pan.

Concurrent with the pivotation of the door, the door machine is repositioned to align the door jamb cleaner with the door jamb. As the jamb cleaner advances to engage the door jamb, another spillage tray, substantially identical to the first, is advanced upwardly in an inclined fashion toward the bottom of the door jamb. The tar build-up and residue scraped off by the jamb cleaner falls onto the second spillage tray and gravitates down the inclined surface of that tray into the catch pan.

The material that accumulates in the catch pan is scraped, by a scraper means, to a position within the catch pan where it is picked up by an inclined conveyor means. The conveyor means carries the material to a collection bucket which stores the material until such time as the door machine becomes located adjacent to a quench car. As such time, the collection bucket is dumped into the quench car, thus disposing of the material.

In the present invention, the spillage and scrapings never actually get to the bench, thus greatly reducing the problem of build up on the track rails of the bench.

These and other features of the present invention will be more completely disclosed and described in the following specification, the accompanying drawings and the appended claims.

DETAILED DESCRIPTION

Figure 1:
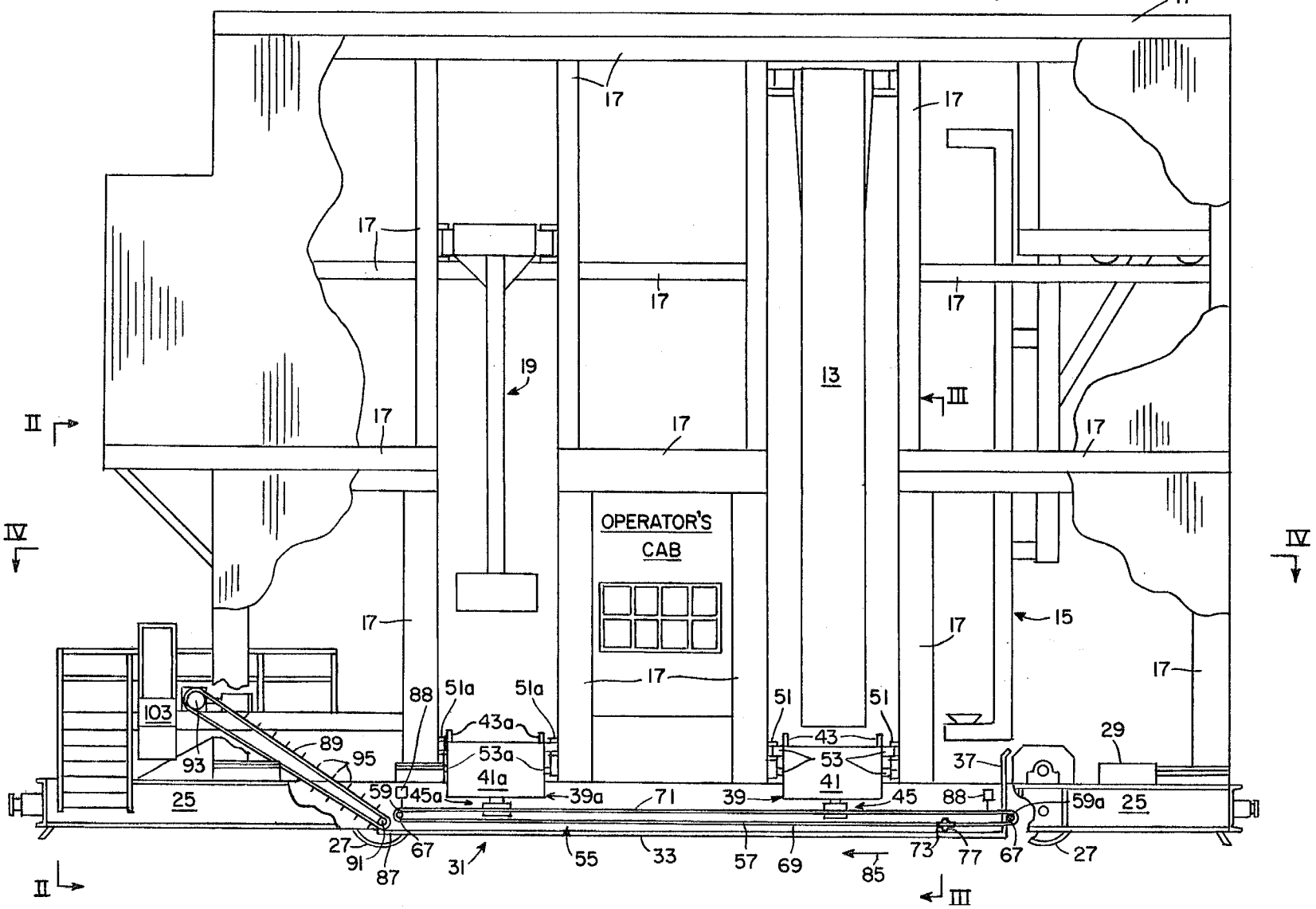
FIG. 1 is an elevation view of a door machine, including the present invention, as seen from the coke side of a coke oven battery.

Referring to FIG. 1 there is shown a typical door machine of modern design, generally designated by the numeral 11, with the improvements of the present invention included therein. The door machine 11 includes door extractor apparatus 13 which serves to extend toward the viewer, as shown in FIG. 1, to engage a selected door (not shown) of the coke oven to be pushed (also not shown). The door extractor apparatus 13 is complemented by a door seal and plug cleaning apparatus 15. In operation, once the door extractor apparatus 13 has disengaged the door from the coke oven, both are withdrawn into the framework 17 of the door machine 11 and the door extractor apparatus 13 pivots the door about 90° to the right, as viewed in FIG. 1. Then the door seal cleaner and plug cleaing apparatus 15 is advanced forward (from right to left as shown in FIG. 1) to engage the door to clean the door seals and the refractory plug surfaces.

Also included in the door machine 11 is a door jamb cleaning apparatus 19. Once the door has been removed from the oven, the door machine 11 is moved out of the way and the coke in the oven is pushed. After the push, the door machine 11 is repositioned to align the door jamb cleaning apparatus 19 with the door jamb (not shown). The moveable coke guide (not shown) is interposed in the operation in between the removal of the door and the cleaning of the door jamb, and the coke oven is pushed before the door jamb is cleaned.

In operation, the door jamb cleaning apparatus 19 is extended toward the viewer, as shown in FIG. 1 to engage the door jamb, which forms the end of the particular oven being pushed. The door jamp cleaning apparatus 19 then cleans the door jamb and is retracted within the framework 17. This operation takes place after the coke push, and the door machine 11 is first moved out of the way along the track rails 21 and the movable coke guide is positioned to align with the coke oven in question. The coke is pushed through the coke guide into quench car 23. Following the push, both the coke guide and quench car 23 are moved away, and the door machine is returned to the point of alignment of the door extractor apparatus 13 with the coke oven in question. The door extractor apparatus 13 then is operated to pivot the door about 90° back to its alignment with the door jamb, advance the door into contact with the door jamb, engage the door locks to secure the door in a closed and sealed position, and withdraw back into the framework 17.

During the initial operation of the door machine 11 as the door is removed from the selected oven, portions of the red hot coke spill out due to the fact that the coal charged into the oven and consequently the coke resulting from the coal carbonization is butressed against the inside of the door. Although most of the coke forms a solid cake, similar to a large cohesive block, within the oven, still, some end portions fall loose. These are the portions which spill out as the door is removed.

During the carbonization of the coal into coke, the volatiles are driven out of the coal by the heat. Significant portions of these volatiles are carbonaceous in composition, for example, coal tars. Theoretically, all of these gasified volatiles are evacuated through the stand pipes and gas mains at the top of the coke oven battery. However, in actuality, due to the heat warpage of the metal which forms the door seals and the door jambs, portions of these gases seep out through the doors. Because these metal portions are relatively cold compared to the interior of the coke oven, the gases condense and form residue build-ups on the surfaces. If the seal and jamb surfaces are not cleaned frequently, the mating seal surfaces on the doors and door jambs become less and less effective as the doors are removed and replaced during the normal coking cycle. These surfaces, as well as the refractory plug which forms most of the interior of the door surface which is exposed to the inside of the coke oven, are cleaned by mechanical metal scrapes which scrape off these residue build-ups.

Again referring to FIG. 1, the framework 17 is a superstructure, usually made up of conventional steel structural shapes such as I-Beams, channels, etc., all of which are mounted to base frame 25. Affixed to base frame 25 are preferably two pairs of bearings mounted wheeled axle assemblies 27 which serve to render the door machine 11 movable on track rails 21. The door machine may be pulled or pushed by a locomotive (not shown) which likewise travels on track rails 21. Alternately, the door machine is equipped with a traction motor drive unit 29 for self-propulsion, which is preferred.

Within the base frame 25 there is mounted, in a fixed position, a catch pan 31. The catch pan 31 is shaped and positioned to substantially enclose the lowermost portion of the base frame 25 between the two wheeled axle assemblies 27 as shown in FIG. 1. The catch pan 31 is composed of a horizontal button sheet 33, two longitudinal sides 35 disposed on the opposite side edges of the sheet 33 and an end shield 37 which serves to also protect the wheeled axle assembly 27, which is driven by the traction motor drive unit 29, from the scrapings falling from the door seal and plug cleaning apparatus 15. All of the scrapings from the door seal and plug cleaning apparatus 15 fall directly into the catch pan 31, as well as, indirectly, do the scrapings from the door jamb cleaning apparatus 19 and the spillage of portions of the red hot coke which results from the removal of the door.

Figure 3:
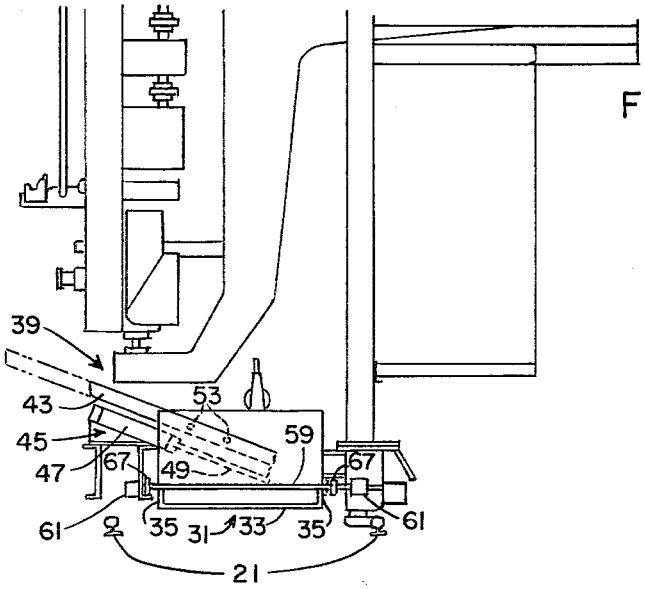
FIG. 3 is a sectional view from III—III of FIG. 1.

Positioned directly beneath the door removal apparatus is a spillage acceptance tray 39 which is generally in the form of an inclined plane as best shown in FIG. 3. The spillage acceptance tray 39 has a bottom or slide 41 and two sides 43. It is reciprocally movable in the plane of the incline, as shown in phantom in FIG. 3, by a suitable reciprocating means, for example, a double acting hydraulic cylinder 45, the body 47 of which is stationarily fixed to the base frame, the extendable rod 49 being mounted to the underside of the slide 41 about as shown in FIG. 3.

In association with the spillage acceptance tray 39, a pair of channel guides 51 are mounted on the framework 17 one each of which is positioned adjacent to each of the sides 43 of the spillage acceptance tray 39 about as shown in FIG. 1. The channel guides 51 are aligned to parallel the plane of the incline of the spillage acceptance tray 39. A pair of rollers 53 is rotatably mounted to each side 43 of the spillage acceptance tray extending into each of the corresponding guide channels 51 so as to permit the spillage acceptance tray 39 to ride in the guide channels 51 as it is reciprocated and to support the spillage acceptance tray 39.

In operation, as the door removal apparatus 13 is extended to engage the selected coke oven door, the spillage acceptance tray 39 is concurrently extended toward that door, to a point on the coke oven battery which is adjacent to the battery, but just below the floor level of the ovens. As the door is removed, those portions of the coke that spill out, fall onto the spillage acceptance tray 39 and gravitate down its inclined plane into the catch pan 31. As the door removal apparatus 13 is retracted into the framework 17, with the door affixed thereto for cleaning, the spillage acceptance tray 39 is, likewise, retracted into the framework 17. Preferably, the retraction of the spillage acceptance tray 39, is delayed for a short time period, for example, 15 to 30 seconds, following the initiation of the retraction of the door removal apparatus 13, to enable the collection of any delayed coke spillage that may result from the door removal.

Following the push, the door machine 11 is repositioned to align the door jamb cleaning apparatus 19 with the subject coke oven, specifically with the door jamb of that coke oven. As detailed before, the door jamb cleaning apparatus 19 advances to engage the door jamb to clean it. The result of this cleaning apparatus is a varying quantity of scrapings of tar and other residue which have built up on the door jamb during the carbonizing cycle.

A second spillage acceptance tray **39*a* is arranged beneath the door jamb cleaning apparatus 19, identical in all respects to the spillage acceptance tray 39 beneath the door removal apparatus 13. The second spillage acceptance tray 39*a* includes a slide 41*a* and two sides 43*a*, and is, likewise, in the form of an inclined plane, being reciprocally movable in the plane of the incline by a similar reciprocation means as exemplified by hydraulic cylinder 45*a*. As explained above for spillage acceptance tray 41, channel guides 51*a* are fixed to framework 17, being located about where shown in FIG. 1. A pair of rollers 53*a* is rotatably mounted outboard of each side 43*a* of spillage acceptance tray 39*a*, the rollers 53*a* being engaged with the respective adjacent channel guides 51*a* to enable alignment and support of the spillage acceptance tray 39*a*** and permit its freely reciprocating movement.

In operation, as the door jamb cleaning apparatus 19 is advanced toward the door jamb, the second spillage acceptance tray **39*a* is concurrently advanced to a point where it is positoned adjacent to the door jamb but just below the floor level of the ovens. The scrapings that result from the operation of the door jamb cleaing apparatus 19 fall onto the slide 41*a* and gravitate down the inclined plane thereof into the catch pan 31. The retraction of the door jamb cleaning apparatus 19 to within the framework 17 is followed closely by the retraction of the second spillage acceptance tray 39*a***.

As mentioned before, when the door removal apparatus 13 is retracted into the framework 17, the door is pivoted about 90° by the door removal apparatus 13. The door seal and plug cleaning apparatus 15 is advanced toward the pivoted door to engage so as to clean or scrape the seal on the door as well as the refractory door plug. The scrapings from this operation fall directly into the catch pan 31.

Figure 4:
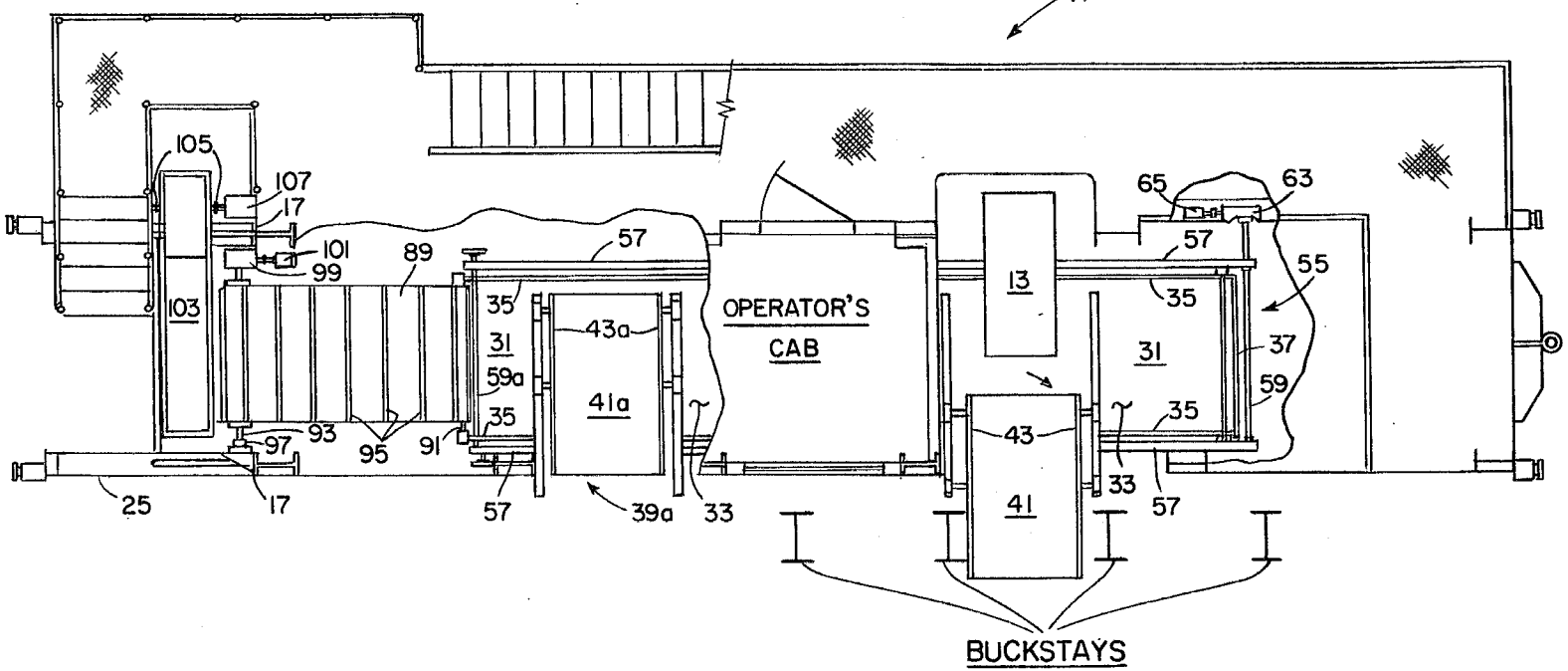
FIG. 4 is a sectional plain view from IV—IV of FIG. 1.

The catch pan 31 serves as a means to accumulate both the spillage and scrapings as described above so as to prevent their being deposited on the coke side bench 22 and the rails 21. The accumulations of these scrapings and the spillage, of course, need to be removed from time to time. To effect this operation a scraper means 55 is mounted to operate within the catch pan 31. Preferably the scraper means 55 includes a pair of continuous scraper chains 57, each of which is positioned to be longitudinally parallel to each other and the longitudinal sides 35 of the catch pan 31 the scraper chains 57 are each mounted outboard of, but adjacent to, the longitudinal sides 35 about as shown in FIGS. 3 and 4.

At both ends of the catch pan 31, rotably mounted axles 59, **59*a* are positioned. The mountings for the axles 59 are preferably bearings 61, as shown in FIG. 3, fixed to the base frame 25. Axle 59 is coupled to a gear reduced 63 which is, in turn, coupled to a reversing drive motor 65, both of which are mounted onto the base frame 25, all as shown best in FIG. 4**.

On each of the axles 59, **59*a* are mounted matched pairs of sprockets 67, positioned to engage the scraper chains 57 respectively. Each of the scraper chains is reeved around a single sprocket 67 on each axle on a given longitudinal side 35 of the catch pan 31, as shown in FIG. 1, and thus is suspended by those sprockets 67 between the axles 59, 59*a***.

Figure 5:
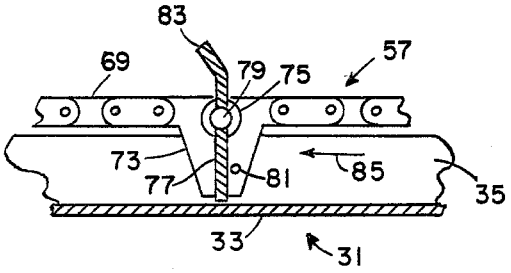
FIG. 5 is an enlarged sectional view of the catch bin scraper.

As will be noted, referring to FIG. 1, although each scraper chain 57 is continuous, as reeved around the sprockets 67 on axles 59, **59*a* respectively, each chain has a lower track 69 and an upper track 71, each of which extends substantially parallel to the other, allowing for slack, and both of which are positioned substantially horizontal, the upper track 71 remaining over the tops of the corresponding sprockets 67 while the lower track 69 runs between the bottoms of the corresponding sprockets 67. Referring to FIG. 5, an enlarged section of the lower track 69 of a scraper chain 57 is shown in relation to the horizontal bottom sheet 33 and a longitudinal side 35 of the catch pan 31. Secluded in the lower track 69 of each scraper chain 57 is a scraper link 73 which depends from the general plane of the lower track 69 about as shown in FIG. 5. Each of the scraper links 73 include a bushing 75. The scraper chains 57 and their respective sprockets 67 are arranged and positioned such that the longitudinal axes of the bushings 75 are axially aligned with each other. A scraper blade 77, having a pair of axially aligned trunions 79, a trunion 79 being disposed at each longitudinal end of the scraper blade 77, is pivotably mounted in the bushings 75. A pin stop 81 is fixed to extend from each of the scraper links 73 to prevent pivotation of the scraper blade 77 past the vertical in one direction, namely to the right as shown in FIG. 5. The uppermost section of the scraper blade 77 is canted away from the side of the scraper blade 77 which comes into contact with the pin stop 81 to provide a leading edge 83 in order to roll any coke that builds up in the direction of travel of the scraper blade 77**.

In operation the scraping action of the scraper blade 77 is in the direction shown by arrow 85 in FIGS. 1 and 5. Reversing drive motor 65 and gear reducer 63 are activated to rotate axle 59 and sprockets 67 mounted thereon. This causes the two scraper chains 57 to concurrently move such that their respective lower tracks 69 advance in the direction of arrow 85. As the lower tracks 69 advance, the scraper blade 77 advances from one end to the other of catch pan 31 in the direction of arrow 85, pushing or scraping all of the spillage and scrapings in catch pan 31 to the discharge end 87 of catch pan 31. When the scraper blade 77 has reached the discharge end 87 of catch pan 31, the direction of rotation of axle 59 is reversed causing the motor of the scraper chains 57 to reverse, thus causing the direction of movement of the scraper blade 77 to reverse. This could be accomplished manually or by a system of limit switches 88. If any spillage or scrapings have been deposited in the catch pan 31 behind the scraper blade 77 during its movement toward the discharge end 87 of the catch pan 31, the scraper blade 77 pivots to the horizontal position when it makes contact that material and rides up over it rather than pushing it in the reverse direction away from the discharge end 87. During this operation, the leading edge 83 tends to prevent the scraper blade 77 from dragging into or becoming wedged against such material.

Adjacent to the discharge end 87 of the catch pan 31 is a chain link flight conveyor belt 89 reeved around an idler pulley 91 and a drive shaft 93. The flights 95 of the conveyor belt 89 extend outwardly therefrom as shown in FIG. 1. The idler pulley 91 is rotably mounted to the longitudinal sides 35 of the catch bin 31 adjacent to the discharge end 87 and is positioned such that the flights just clear the horizontal bottom sheet 33 of the catch bin 31 and the conveyor belt 89 moves. The plane of the conveyor belt 89 is inclined upwardly and away from the discharge end 87 of the catch pan about as shown in FIG. 1. The drive shaft 93 is rotably mounted to the framework 17 at one end by way of a bearing 97, and is coupled to a gear reducer 99 at the other end. The gear reducer 99 is driven by a motor 101 and both are mounted to the framework 17 about as shown in FIG. 4.

In operation, as the scraper blade 77 begins to move in the direction of arrow 85, the motor 101 is energized causing the gear reducer to rotate the drive shaft 93 in a counter-clockwise direction as showin in FIG. 1. This causes the conveyor belt 89 to move, thus rotating the idler pulley 91. As the material being pushed by scraper blade 77 comes into contact with the conveyor belt 89, the flights 95 engage that material causing it to be transported by the conveyor belt 89 movement toward the general location of the drive shaft 93. When the material on the conveyor belt 89 reaches the drive shaft 93 location, it falls off into a dump bucket 103.

Figure 2:
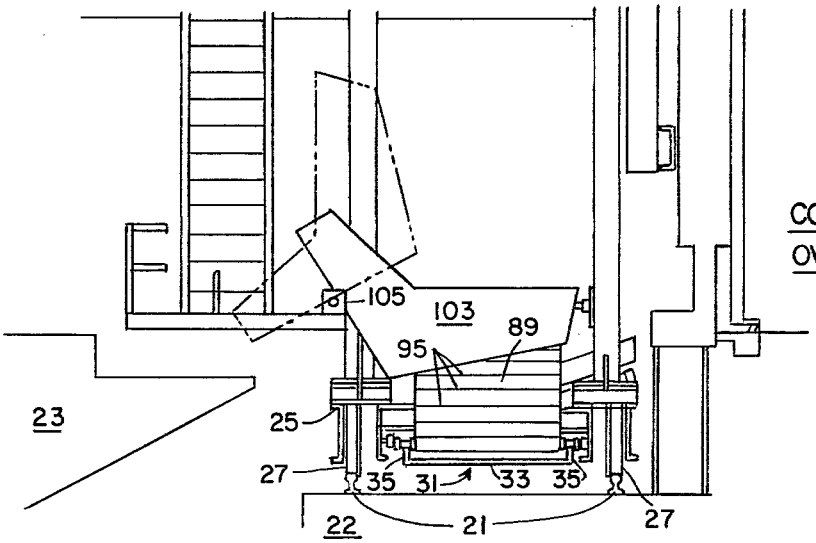
FIG. 2 is a sectional end view from II—II of FIG. 1.

Referring to FIG. 2, dump bucket 103 is pivotably mounted 105 to the framework 17. A tilting means 107, for example a torque actuator as is commonly known to those skilled in the art, is employed to pivot dump bucket 103 when it becomes full of material, permitting the material to gravitate from the dump bucket 103 into an adjacent quench car 23. Of course, the dump bucket 103 is only emptied after the movement of the conveyor belt 89 has been halted, following the return of the scraper blade 77 to its original position as shown in FIG. 1, thus preventing spillage of material onto the coke side bench and rails 21 from the conveyor belt 89 which could otherwise occur when the dump bucket 103 is in its pivoted position as shown in phantom in FIG. 2.

According to the provisions of the patent statutes, the principle, preferred construction and mode of operation of the present invention have been explained and its best presently known embodiment has been illustrated and described. However, it is to be understood that, within the scope of the appended claims, the present invention may be practical otherwise than as specifically illustrated and described hereinabove.

What is claimed is:

1. In a coke oven battery door machine, including door removal apparatus, door seal and plug cleaning apparatus and door jamb cleaning apparatus, coke side bench cleaning apparatus comprising:

(a) means for collecting the coke spillage that is associated with the removal of coke side doors mounted onto said door machine;

(b) means for collecting the seal and plug scrapings that result from the operation of said door seal and plug cleaning apparatus mounted onto said door machine;

(c) means for collecting the jamb scrapings that result from the operation of said door jamb cleaning apparatus, mounted onto said door machine;

(d) means for moving said coke spillage, said seal and plug scrapings and said jamb scrapings to a discharge area within said door machine, said means for moving which is mounted onto said door machine;

(e) means for accumulating said coke spillage, said seal and plug scrapings and said jamb scrapings which have been moved to said discharge area, said means for accumulating which are mounted onto said door machine;

(f) means for conveying said coke spillage, said seal and plug scrapings and said jamb scrapings from said discharge area to said means for accumulating, said means for conveying which are mounted onto said door machine; and (g) means for emptying, away from said coke side bench, said means for accumulating.

2. The invention described in claim 1 wherein said means for moving said coke spillage, said door seal and plug scrapings and said jamb scrapings comprises a chain driven scraper blade operable in relation to said means for collecting said door seal and plug scraping and wherein said means for collecting the coke spillage and said means for collecting the jamb scrapings are operable to deposit said door seal and plug scrapings into said means for collecting said door seal and plug scrapings.

3. The invention described in claim 2 wherein said means for collecting the coke spillage and said means for collecting the jamb scrapings both comprise reciprocally movable inclined trays which are extendible from said door machine to a point adjacent to, but just below, the floor level of the coke ovens of said coke oven battery.

4. The invention described in claim 1 wherein said means for collecting said door seal and plug scrapings includes a catch pan positioned adjacent to the bottom of said door machine and said means for moving said spillage comprises a chain driven scraper blade operable to scrape material which accumulates throughout said catch bin to a discharge area end of said catch bin.

5. The invention described in claim 4 wherein said means for collecting the coke spillage and said means for collecting the jamb scrapings both comprise reciprocally movable inclined trays which are extendible from said door machine to a point adjacent to, but just below, the floor level of the coke ovens of said coke oven battery.

6. The invention described in claim 5 wherein said means for accumulating comprises a pivotably mounted dump bucket positioned at the end of said means for conveying which is remote from said discharge area end of said catch pan and wherein said means for emptying comprises means for tilting said dump bucket on its said pivotal mounting.

7. The invention described in claim 6 wherein said means for conveying comprises a power driven flight conveyor belt.

8. The invention described in claim 1 wherein said means for collecting the coke spillage and said means for collecting the jamb scrapings both comprise reciprocally movable inclined trays which are extendible from said door machine to a point adjacent to, but just below, the floor level of the coke ovens of said coke oven battery.

9. The invention described in claim 1 wherein said means for accumulating comprises a pivotably mounted dump bucket positioned at the end of said means for conveying which is remote from said discharge area and wherein said means for emptying comprises means for tilting said dump bucket by pivoting said dump bucket on its said pivotal mounting.

10. The invention described in claim 1 wherein said means for conveying comprises a power driven flight conveyor belt.

* * * * *